US009527105B2

(12) United States Patent
Tani

(10) Patent No.: US 9,527,105 B2
(45) Date of Patent: Dec. 27, 2016

(54) APPLYING MATERIAL EXTRUDING CONTAINER

(71) Applicant: TOKIWA CORPORATION, Nakatsugawa-shi, Gifu (JP)

(72) Inventor: Yoshikazu Tani, Kawaguchi (JP)

(73) Assignee: TOKIWA CORPORATION, Kawaguchi-shi (JP)

( * ) Notice: Subject to any disclaimer, the term of this patent is extended or adjusted under 35 U.S.C. 154(b) by 0 days.

(21) Appl. No.: 14/580,533

(22) Filed: Dec. 23, 2014

(65) Prior Publication Data

US 2015/0202649 A1 Jul. 23, 2015

(30) Foreign Application Priority Data

Jan. 21, 2014 (JP) ..... 2014-008765
Jun. 12, 2014 (JP) ..... 2014-121501

(51) Int. Cl.

| | |
|---|---|
| ***B43M 11/06*** | (2006.01) |
| ***B05C 17/005*** | (2006.01) |
| ***A45D 40/20*** | (2006.01) |
| ***A46B 11/00*** | (2006.01) |
| ***A45D 34/04*** | (2006.01) |

(52) U.S. Cl.

CPC ..... *B05C 17/00516* (2013.01); *A45D 34/04* (2013.01); *A45D 40/205* (2013.01); *A46B 11/0041* (2013.01)

(58) Field of Classification Search

CPC ..... A45D 40/205; A46B 11/0041
USPC ..... 401/183–184
See application file for complete search history.

(56) References Cited

U.S. PATENT DOCUMENTS

| | | | | |
|---|---|---|---|---|
| 3,386,792 | A * | 6/1968 | Ireland | B44D 3/04 401/123 |
| 7,857,538 | B2 * | 12/2010 | Nasu | A45D 34/04 401/171 |
| 9,044,078 | B2 * | 6/2015 | Tani | A45D 34/042 |
| 2011/0315719 | A1 | 12/2011 | Tani | |
| 2014/0328611 | A1 | 11/2014 | Ishida | |
| 2014/0341632 | A1 | 11/2014 | Ishida | |

FOREIGN PATENT DOCUMENTS

JP 2006-136774 A 6/2006

* cited by examiner

*Primary Examiner* — Jennifer C Chiang
(74) *Attorney, Agent, or Firm* — Westerman, Hattori, Daniels & Adrian, LLP

(57) ABSTRACT

An applying material extruding container includes a leading portion including a filling portion filled with an applying material and a flat applying portion and a grip tube inserted into the leading portion. The applying material is extruded from a discharge portion on a leading end side of the applying portion by pressing and deforming the filling portion so as to be used. The applying material extruding container includes an annular middle member engaged with the leading portion and the grip tube. An outer peripheral surface of a rear end portion in the filling portion is provided with a collar portion extending along a peripheral direction. An inner peripheral surface of a front end portion in the middle member is provided with an inner peripheral projection which extends along the peripheral direction. The collar portion and the inner peripheral projection are engaged with each other in an axial direction.

3 Claims, 10 Drawing Sheets

APPLYING MATERIAL EXTRUDING CONTAINER

TECHNICAL FIELD

The present invention relates to an applying material extruding container used by extruding an applying material.

BACKGROUND ART

As an existing applying material extruding container, for example, as described in Patent Document 1, a container which includes a filling member filled with an applying material (filling material for application) in a filling region therein and a leading portion (applying body) that is provided on the leading end side of the filling member to apply the applying material is known. In the applying material extruding container described in Patent Document 1, the filling region is filled with the applying material in a state where a curved disk-shaped applying portion provided with a discharge portion in the leading portion is depressed, and thereafter, the applying portion elastically recovers, thereby forming a predetermined space on the inside including the discharge portion of the applying portion.

CITATION LIST

Patent Literature

Patent Literature 1: Japanese Unexamined Patent Application Publication No. 2006-136774

SUMMARY OF INVENTION

Problems to be Solved by the Invention

However, in the existing applying material extruding container, for example, in a case where the leading portion is formed of a soft material, there may be a case where the leading portion is detached from the rear portion of the container. Here, an object of the present invention is to provide an applying material extruding container capable of preventing a leading portion from being detached from the rear portion of the container.

Solution to Problem

In order to accomplish the object, an applying material extruding container according to an aspect of the present invention includes: a leading portion which includes a filling portion filled with an applying material and a flat applying portion and is molded of a soft material; and a rear portion of the container which is inserted into the leading portion, wherein the applying material is extruded from a discharge portion on a leading end side of the applying portion by pressing and deforming the filling portion so as to be used, an annular middle member which is engaged with the leading portion and the rear portion of the container is further included, an outer peripheral surface of a rear end portion in the filling portion is provided with an outer peripheral projection which extends along a peripheral direction, an inner peripheral surface of a front end portion in the middle member is provided with an inner peripheral projection which extends along the peripheral direction, and the outer peripheral projection and the inner peripheral projection are engaged with each other at least in an axial direction.

In the applying material extruding container, the middle member is provided, and the outer peripheral projection provided on the outer peripheral surface of the rear end portion in the filling portion and the inner peripheral projection provided on the inner peripheral surface of the front end portion in the middle member are engaged with each other at least in the axial direction. Therefore, it is possible to prevent the leading portion from being separated from the rear portion of the container.

In the applying material extruding container according to the aspect of the present invention, the rear end portion of the filling portion in the leading portion may be interposed between an inserting portion of the rear portion of the container which is inserted into the filling portion and the front end portion of the middle member in a radial direction. In this case, it is possible to further prevent the leading portion from being separated from the rear portion of the container. In addition, the inside diameter of the rear portion of the leading portion comes into close contact with the inserting portion of the rear portion of the container and thus airtightness therebetween can be reliably ensured.

In the applying material extruding container according to the aspect of the present invention, the leading portion may be formed of a soft rubber of which a durometer hardness measured by a type A durometer is less than 80 or an elastic body made of a thermoplastic elastomer, and the middle member and the rear portion of the container may be formed of a hard thermoplastic resin. In a case where the leading portion, the middle member, and the rear portion of the container are formed of such materials, the effect of preventing the leading portion from being separated becomes significant.

Advantageous Effects of Invention

According to the present invention, it is possible to provide the applying material extruding container capable of preventing the leading portion from being separated from the rear portion of the container.

DESCRIPTION OF EMBODIMENTS

Figure 1:
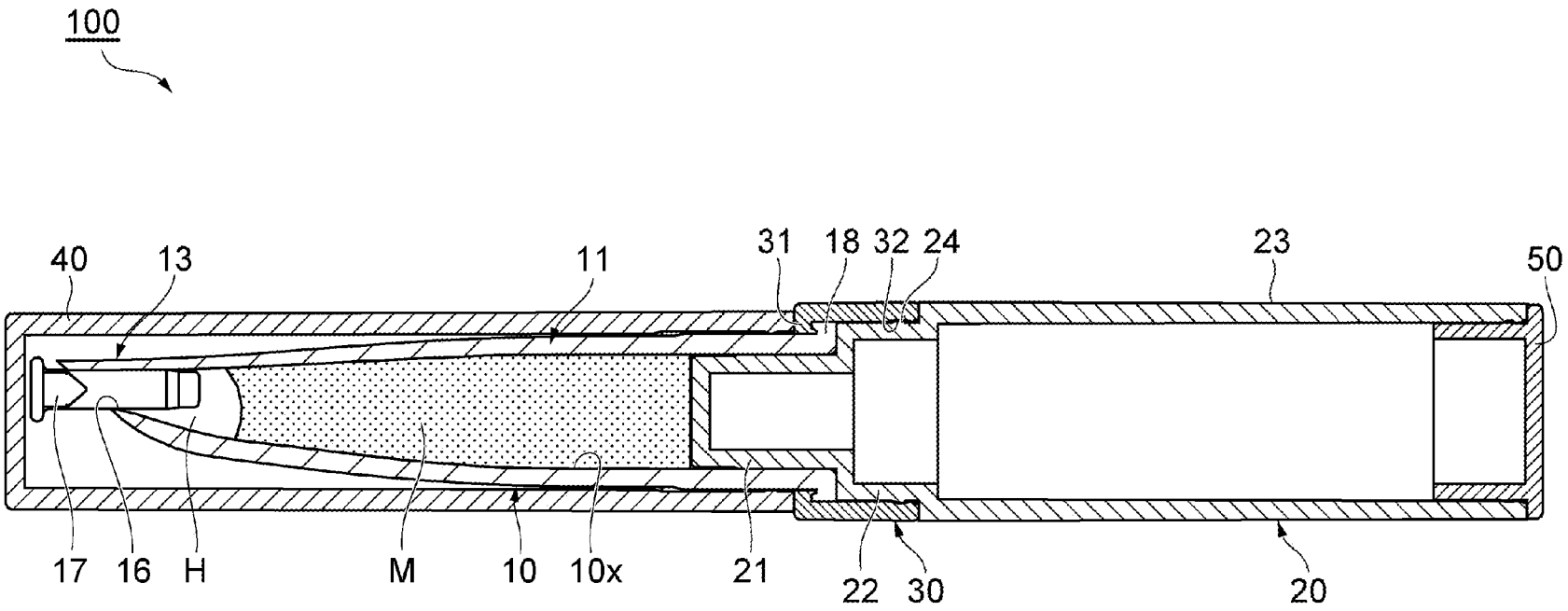
FIG. 1 is a longitudinal cross-sectional view illustrating an initial state of an applying material extruding container according to an embodiment.

Hereinafter, exemplary embodiments of the present invention will be described in detail with reference to the drawings. In addition, in the following description, like elements are denoted by like reference numerals, and overlapping descriptions will be omitted.

Figure 2:
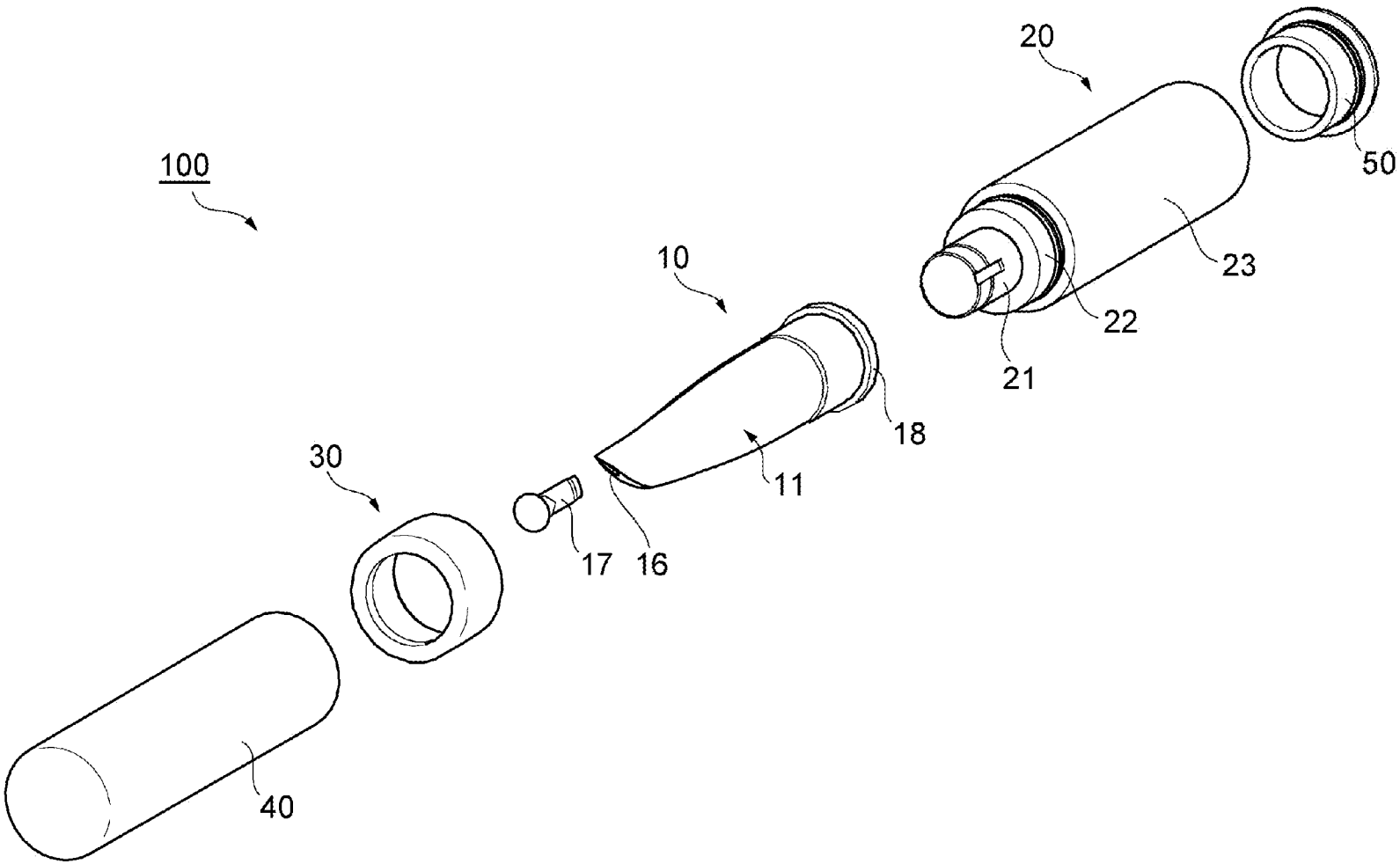
FIG. 2 is an exploded perspective view illustrating the applying material extruding container of FIG. 1.

FIG. 1 is a longitudinal cross-sectional view illustrating an initial state of an applying material extruding container according to an embodiment, and FIG. 2 is an exploded perspective view illustrating the applying material extruding container of FIG. 1. As illustrated in FIGS. 1 and 2, an applying material extruding container 100 of this embodiment is used by appropriately extruding an applying material M filling the inside thereof by an operation of a user.

As the applying material M, for example, eyeliner, eye color, eye shadow, eyebrow, lip gloss, lip, lip liner, cheek color, beauty liquid, beauty stick, cleansing liquid, cleansing oil, nail enamel, nail care solution, nail remover, mascara, anti-aging, hair color, hair applying material, oral care, massage oil, blackhead removing liquid, foundation, concealer, skin cream, ink for writing implements, various types of liquids containing medicine or the like, jelly form, gel form, paste form, soft form, mousse form, kneaded form, muddy form, semisolid form, soft solid form, solid form, and the like may be used.

In addition, by blending the applying material M with a volatile solvent (for example, silicone oil such as cyclopentasiloxane or hydrocarbon oil such as isododecane or isohexadecane) in addition to a pigment, an oil agent, wax, or the like, the retention thereof may be increased. As an appropriate example of the applying material M, for example, a make-up cosmetic material such as a gel-like eyeliner which is blended with a volatile component (volatile solvent) and thus has high long-lasting properties may be used.

In addition, as the applying material M, a gel-like or semisolid material having high viscosity or hardness and thus having high compressibility is preferably used. Particularly preferably, an applying material M having a hardness of about 0.1 N to 0.3 N may be used. The hardness of the applying material M is obtained by a general measuring method used to measure the hardness of cosmetics. Here, for example, FUDOH RHEO METER [RTC-2002D. D] (made by RHEOTECH) is used as a measurer, and when a steel rod (adapter 1) of ϕ3 mm is inserted into the applying material M at a depth of about 10 mm at a velocity of 6 cm/min under the condition of an atmospheric temperature of 25° C., a force (strength) of the corresponding applying material M at the time of peak is measured as a hardness (penetration).

The applying material extruding container 100 includes a leading portion 10 including a filling region 10*x* filled with the applying material M therein, a grip tube 20 as the rear portion of the container, which is inserted from the rear side in an axial direction with respect to the leading portion 10, a middle member 30 engaged with the leading portion 10 and the grip tube 20, and a cap 40 detachably mounted on the leading portion 10 to cover the leading portion 10. In addition, "axis" means a center line that extends toward the front and the rear of the applying material extruding container 100, and the "axial line" means a direction along the axis (forward and rearward direction).

Figure 3:
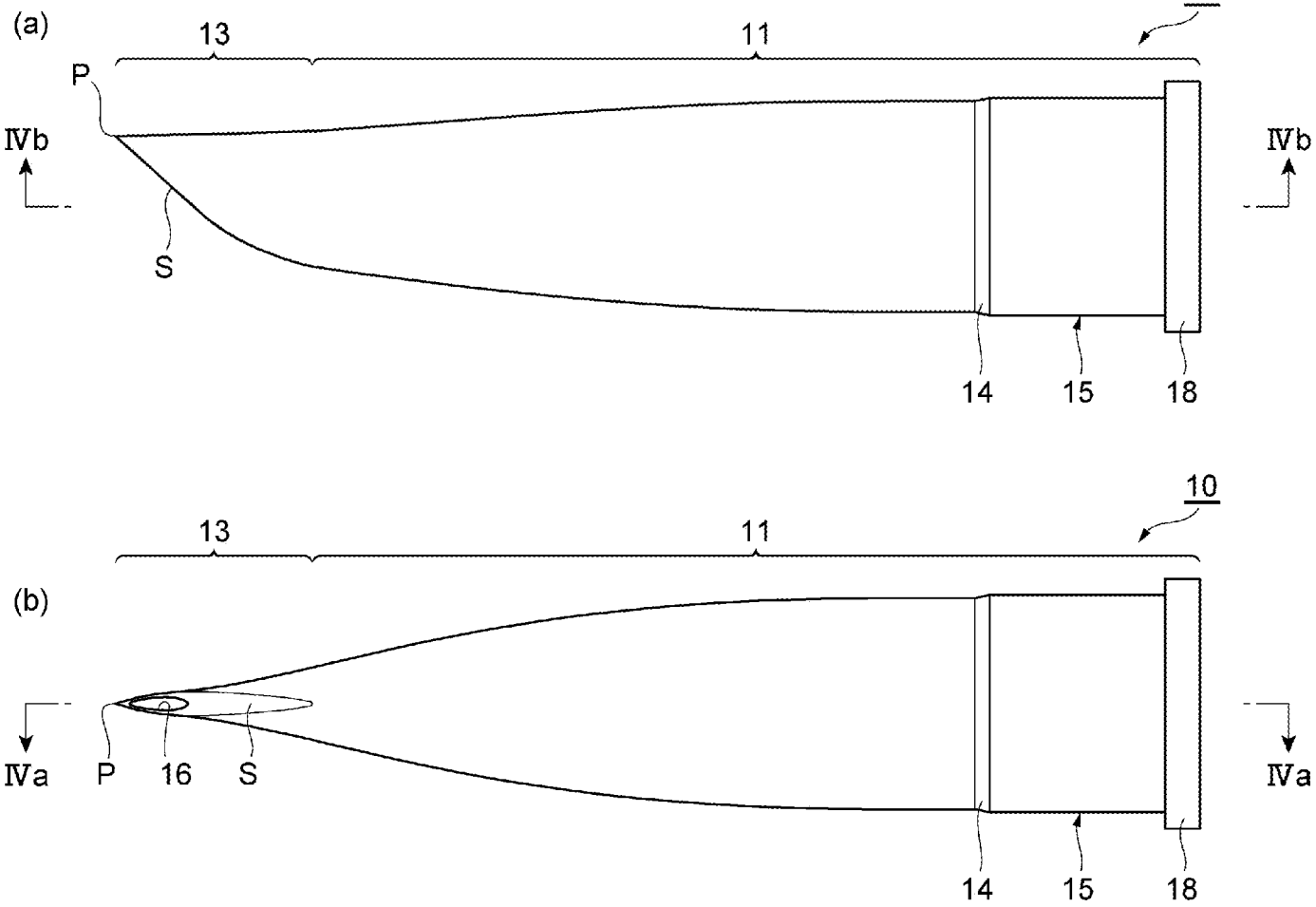
FIG. 3 is a view illustrating a leading portion of the applying material extruding container of FIG. 1.
Figure 4:
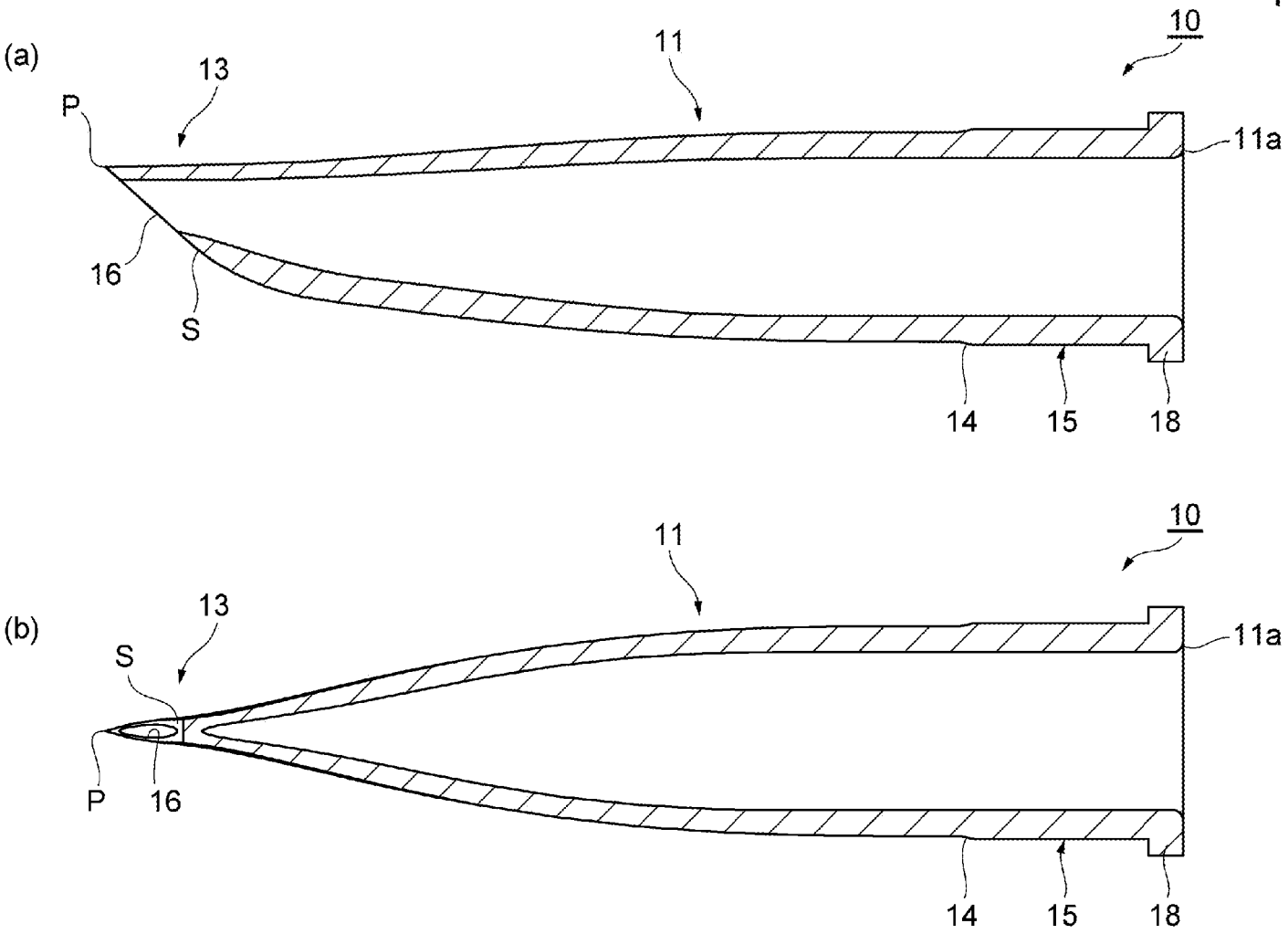
FIG. 4 is another view illustrating the leading portion of the applying material extruding container of FIG. 1.

FIG. 3(*a*) is a side view illustrating the leading portion in the applying material extruding container of FIG. 1, and FIG. 3(*b*) is a bottom view illustrating the leading portion of the applying material extruding container of FIG. 1. FIG. 4(*a*) is a cross-sectional view taken along line IVa-IVa of FIG. 3(*b*), and FIG. 4(*b*) is a cross-sectional view taken along line IVb-IVb of FIG. 3(*a*). As illustrated in FIGS. 3 and 4, the leading portion 10 is for filling and applying the applying material M and forms the leading end portion of the applying material extruding container 100.

The leading portion 10 is formed of a soft material. As the soft material, for example, general thermosetting soft rubber molded by heating through vulcanization, or an elastic body made of a thermoplastic elastomer which is a type of plastic and is plasticized by heat and molded by being poured into a mold may be used.

As the soft rubber, nitrile rubber (NBR), butyl rubber (IIR), ethylene-propylene rubber (EPDM), or silicone rubber (Q) may be mainly employed. Among these, particularly nitrile rubber has excellent oil resistance to a volatile solvent. In addition, as the elastic body made of a thermoplastic elastomer, polyester-based elastomer (TPEE), olefin-based elastomer (TPO), or urethane-based elastomer (TPU) may be mainly employed. Among these, in the urethane-based elastomer, any of two types including the polyester type and the polyether type soft segments with the polyurethane hard segments may be used. For the applying material M, the polyether type soft segments are particularly appropriate.

In addition, the durometer hardness of the leading portion 10 measured by a type A durometer specified in JIS K 6253 is preferably less than 80. As illustrated, the leading portion 10 has a pointed shape on the leading end side. The leading portion 10 includes a filling portion 11 including the filling region 10*x*, and a flat applying portion 13 provided to be connected to the leading end side of the filling portion 11.

The filling portion 11 has a shape in which the transverse cross-sectional outer shape thereof changes from a substantially circular shape to a flat shape from the base end side toward the leading end side. Specifically, the filling portion 11 has a substantially circular shape from the base end side to the center portion in the axial direction and gradually becomes flattened toward the leading end side from the center portion (the diameter in the lateral direction as a minor-axis direction is reduced). In addition, the filling portion 11 has a substantially constant thickness, and the inner peripheral surface of the filling portion 11 is formed to follow the outer shape. On the base end side of the filling portion 11, a base end portion 15 which is increased in diameter via a stepped portion 14 is provided. In the rear end portion of the base end portion 15, a collar portion 18 which is engaged with the middle member 30 (see FIG. 1) as an outer peripheral projection that projects outward in the radial direction and extends along the peripheral direction is formed.

The applying portion 13 is for applying the applying material M and is formed so that the transverse cross-sectional outer shape thereof has a flat circle shape and a rounded shape in a view in the lateral direction. Here, the lateral direction corresponds to the minor-axis direction of the flat shape and, for example, is equivalent to the up and down direction shown in FIG. 3(*b*) (hereinafter, the same is applied). The leading end surface of the applying portion 13 has an applying surface S which abuts on an applying object such as the skin of a user. The applying surface S is inclined at a predetermined angle with respect to the axial direction and is an elongated flat surface in the forward and rearward direction. At the leading end of the applying surface S, an apex P is formed. The applying surface S is provided with an opening that penetrates through the leading portion 10, and the opening forms a discharge portion 16 for discharging the applying material M. A plug 17 is detachably inserted into the discharge portion 16 for sealing (airtightness).

Here, on the discharge portion 16 side in the leading portion 10 (the leading end side of the filling region 10*x* of the filling portion 11), a predetermined space H optimized to suppress the discharge of the applying material M from the discharge portion 16 due to a temperature change or the like is formed. The predetermined space H is defined by the inner wall of the leading portion 10 and the front end surface of the applying material M. The predetermined space H is defined by inserting the applying material M from a rear end opening 11*a* of the filling portion 11 in a state where the filling portion 11 is deformed to reduce the volume in the filling portion 11 by pressing the sides of the filling portion 11, thereafter recovering the shape of the filling portion 11 to its original shape by releasing the pressing, and inserting the grip tube 20 into the shape-recovered filling portion 11 by a predetermined amount to be assembled with each other so as to cause the applying material M to move forward (details will be described later).

Figure 5:
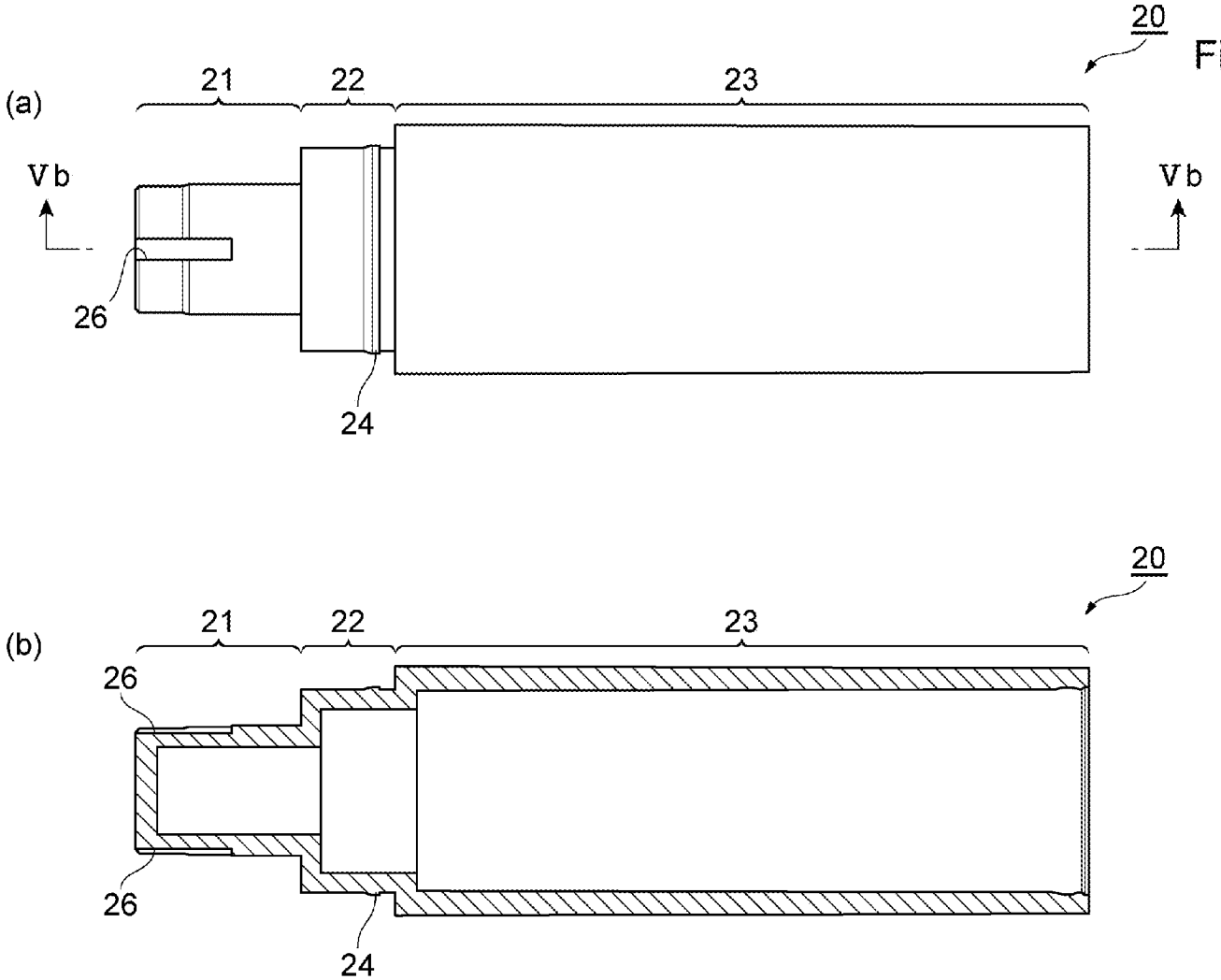
FIG. 5 is a view illustrating a grip tube of the applying material extruding container of FIG. 1.

FIG. 5(*a*) is a side view illustrating the grip tube which forms the rear portion of the container in the applying material extruding container of FIG. 1, and FIG. 5(*b*) is a cross-sectional view taken along line Vb-Vb of FIG. 5(*a*). As illustrated in FIG. 5, the grip tube 20 is a member gripped by the user at the time of use and is formed by injection mold of a hard thermoplastic resin. The grip tube 20 has a stepped cylindrical shape of which the front side is blocked, and an inserting portion 21, an engaging portion 22, and a body portion 23 are included in this order from the front toward the rear. The inner peripheral surface of the grip tube 20 has a stepped shape that follows the outer shape.

The inserting portion 21 is inserted and fitted into the filling portion 11 of the leading portion 10 and has an outside diameter that is slightly greater than the inside diameter of the base end portion 15 of the filling portion 11. The engaging portion 22 has an outside diameter that is greater than that of the inserting portion 21. The outer peripheral surface of the engaging portion 22 is provided with an annular convex portion 24 which is engaged with the middle member 30 in the axial direction, projects outward in the radial direction, and extends along the peripheral direction. The body portion 23 has an outside diameter that is greater than that of the engaging portion 22. As illustrated in FIG. 1, a tail plug 50 is inserted and mounted into the rear end side of the body portion 23 such that the opening of the grip tube 20 on the rear end side is closed.

In the grip tube 20 described above, the inserting portion 21 thereof is inserted from the rear and fitted into the filling portion 11 of the leading portion 10, and the front surface of the engaging portion 22 thereof enters a state of abutting on the rear end surface of the filling portion 11. Accordingly, the grip tube 20 is mounted to the leading portion 10.

Figure 6:
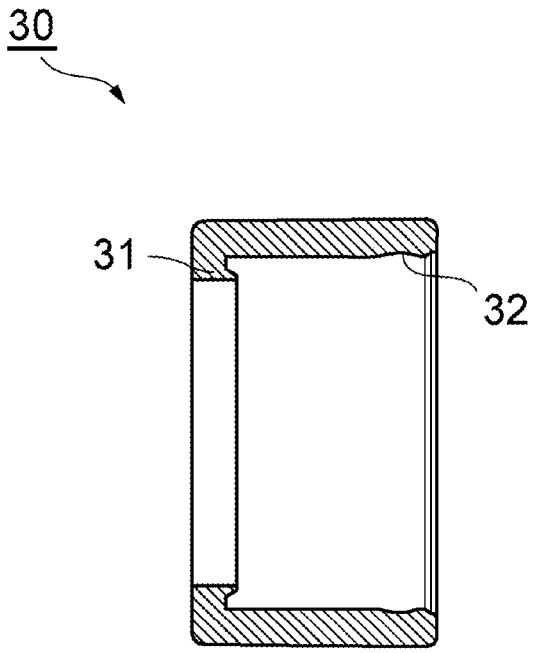
FIG. 6 is a longitudinal cross-sectional view illustrating a middle member of the applying material extruding container of FIG. 1.

FIG. 6 is a longitudinal cross-sectional view illustrating the middle member of the applying material extruding container of FIG. 1. As illustrated in FIG. 6, the middle member 30 has a tubular shape (annular shape), and is formed by injection molding of a hard thermoplastic resin like the grip tube 20. In the middle member 30, the inner peripheral surface of the front end portion is provided with an inner peripheral projection 31 which is engaged with the collar portion 18 of the leading portion 10, projects inward in the radial direction, and extends along the peripheral direction. The inner peripheral projection 31 has a hook shape in which the end portion of the inner side thereof in the radial direction projects rearward. In the middle member 30, the inner peripheral surface of the rear end portion is provided with an annular concave portion 32 which is engaged with the annular convex portion 24 of the grip tube 20, is depressed inward in the radial direction, and extends along the peripheral direction.

As illustrated in FIG. 1, the rear end portion of the filling portion 11 of the leading portion 10 is inserted into the middle member 30 described above, and the inner peripheral projection 31 is engaged with the collar portion 18 of the leading portion 10. At this time, since the collar portion 18 is formed of a soft material and the inner peripheral projection 31 has the hook shape, the inner peripheral projection 31 is embedded in the collar portion 18 to be engaged with each other. Accordingly, the middle member 30 is engaged with the leading portion 10 in the axial direction and the radial direction. In addition, at this time, the middle member 30 and the inserting portion 21 of the grip tube 20 causes the rear end portion of the filling portion 11 to be interposed therebetween.

Simultaneously, the engaging portion 22 of the grip tube 20 is inserted into the middle member 30 until the front surface of the body portion 23 of the grip tube 20 abuts on the rear end surface thereof, and the annular convex portion 24 of the engaging portion 22 is engaged with the annular concave portion 32 in the axial direction. Accordingly, the middle member 30 is mounted on the leading portion 10 and the grip tube 20 to be connected to the leading portion 10 and the grip tube 20 in the axial direction, and is interposed between the leading portion 10 and the grip tube 20.

In the applying material extruding container 100 which is configured as described above and is in the initial state illustrated in FIG. 1, after the cap 40 and the plug 17 are detached by the user, the sides of the filling portion 11 of the leading portion 10 are appropriate pressed. Accordingly, the applying material M filling the filling region 10*x* is discharged from the discharge portion 16. In addition, the applying material M is applied to an applying object.

Figure 7:
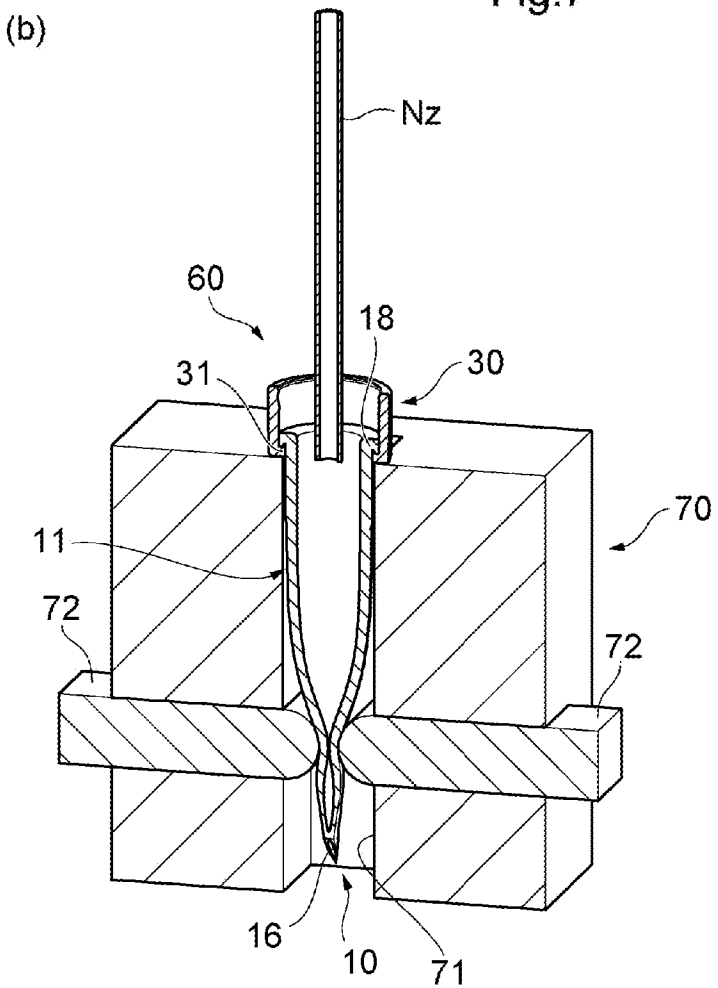
FIG. 7 is a view illustrating a method of manufacturing the applying material extruding container of FIG. 1.
Figure 7:
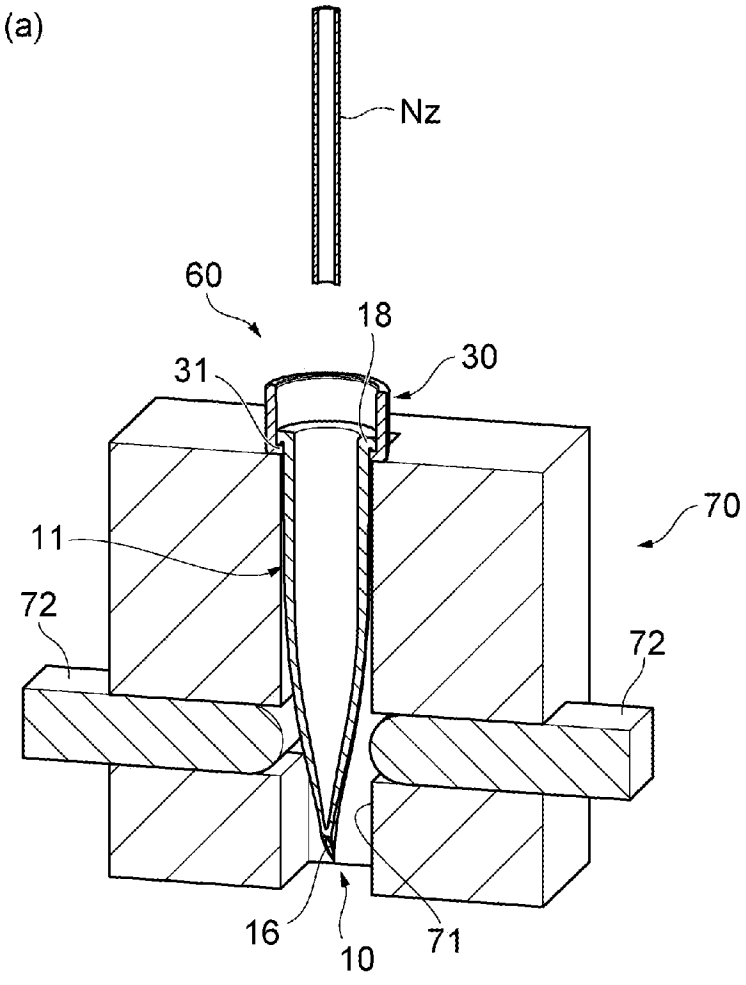

Next, a method of manufacturing the applying material extruding container 100 described above will be described. Here, an example of inserting the applying material M and assembling components will be described in detail. FIG. 7(*a*) is an explanatory view of the insertion of the applying material M into the applying material extruding container 100 of FIG. 1 and of assembly, FIG. 7(*b*) is a view subsequent to FIG. 7(*a*), FIG. 8(*a*) is a view subsequent to FIG. 7(*b*), FIG. 8(*b*) is a view subsequent to FIG. 8(*a*), FIG. 9(*a*) is a view subsequent to FIG. 8(*b*), and FIG. 9(*b*) is a view subsequent to FIG. 9(*a*).

As illustrated in FIG. 7(*a*), the rear end portion of the leading portion 10 is inserted into the middle member 30 so that the inner peripheral projection 31 is engaged with the collar portion 18 and the middle member 30 is mounted on the leading portion 10, thereby obtaining a container middle body 60. In addition, the container middle body 60 is inserted into a holding hole 71 of a filling tool 70 from the front side, and the container middle body 60 is held in an upright posture in which the opening of the container middle body 60 on the rear side is open upward.

At this time, the front side of the middle member 30 abuts on the upper surface of the filling tool 70. In addition, on the sides of the filling portion 11 at a predetermined position on the leading end side, a pair of pressing portions 72 is in a state of opposing each other in the filling tool 70. The pair of pressing portions 72 are provided to approach each other and to be separated from each other in a direction along the minor-axis direction of the applying portion 13. In addition, in the illustrated example, the predetermined position at which the pair of pressing portions 72 are disposed is a position on the leading end side from the center portion in the axial direction of the filling portion 11 which gradually becomes flattened.

Subsequently, as illustrated in FIG. 7(*b*), a nozzle Nz is allowed to enter the filling portion 11 of the leading portion 10 from the rear side (upper side). Simultaneously, the pair of pressing portions 72 are moved to approach each other so that the curved leading end portions of the pressing portions 72 are pressed against each other while the predetermined position of the sides of the filling portion 11 is interposed therebetween. Accordingly, the filling portion 11 is deformed to reduce the volume of the filling portion 11. The deformation of the filling portion 11 at this time may be achieved to completely block the inside of the filling portion 11 or substantially block the inside (block the inside with a gap). That is, the filling portion 11 may be blocked and reduced in volume so as not to cause the applying material M filling the rear end to slip down.

Figure 8:
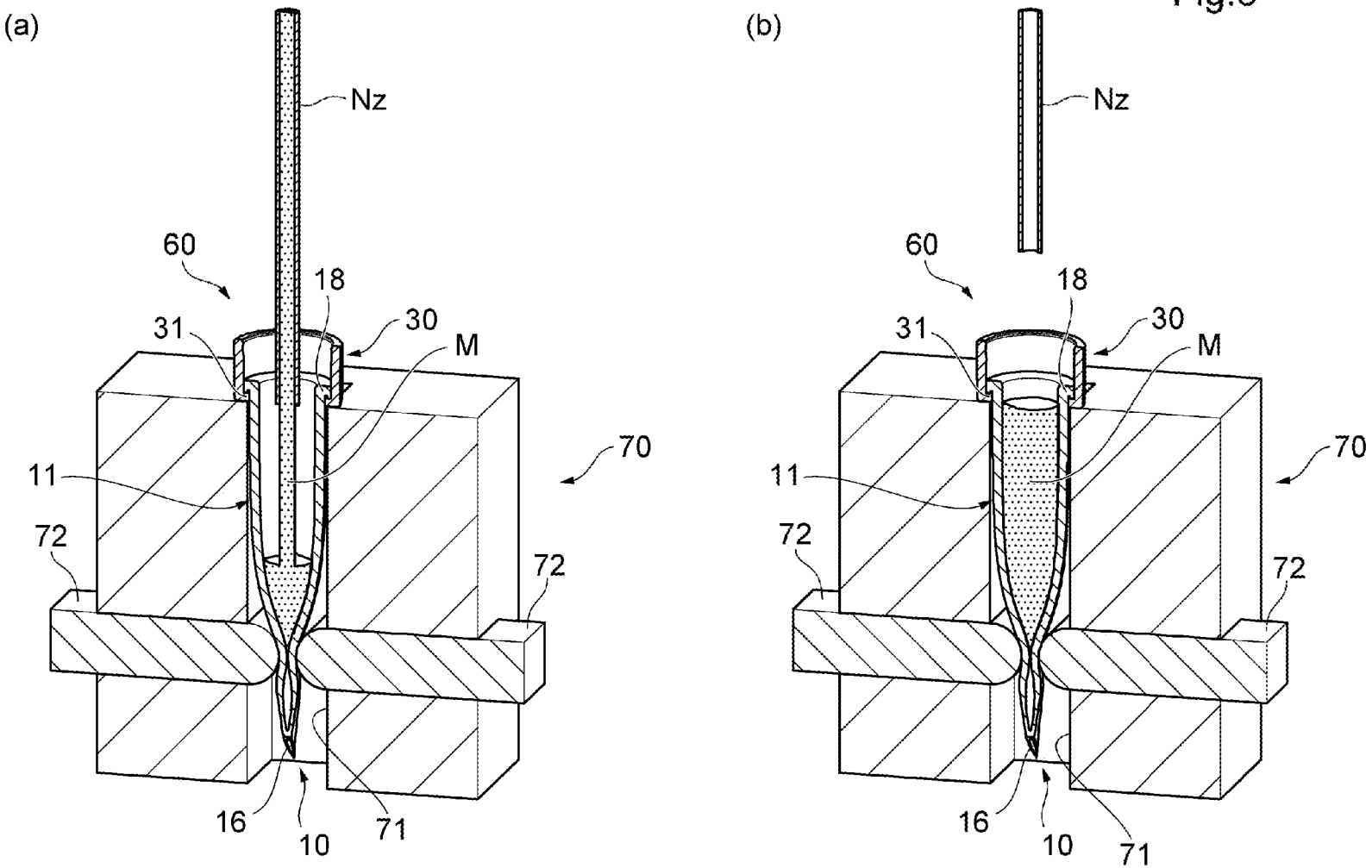
FIG. 8 is another view illustrating the method of manufacturing the applying material extruding container of FIG. 1.

Subsequently, as illustrated in FIG. 8(*a*), in the state where the filling portion 11 is deformed, the applying material M which is dissolved by increasing the temperature thereof to, for example, about 80° C. is injected into the filling portion 11 from the nozzle Nz. Accordingly, the applying material M is inserted into the filling portion 11 from the position on the opening side where the filling portion 11 is pressed and deformed by the pressing portions 72 as a starting point. In addition, as illustrated in FIG. 8(*b*), the applying material M is inserted to a required amount, and thereafter, the nozzle Nz is moved upward to retreat from the filling portion 11. Here, during the assembly of the grip tube 20 at the rear end (see FIG. 9(*b*)), a predetermined amount or more of the applying material M is inserted so that no gap is formed between the inserting portion 21 and the applying material M. The applying material M is left for a predetermined cooling time immediately after the insertion (while being inserted) or after the insertion so as to solidify to a degree at which it does not slip down from the filling portion 11 under its own weight.

Figure 9:
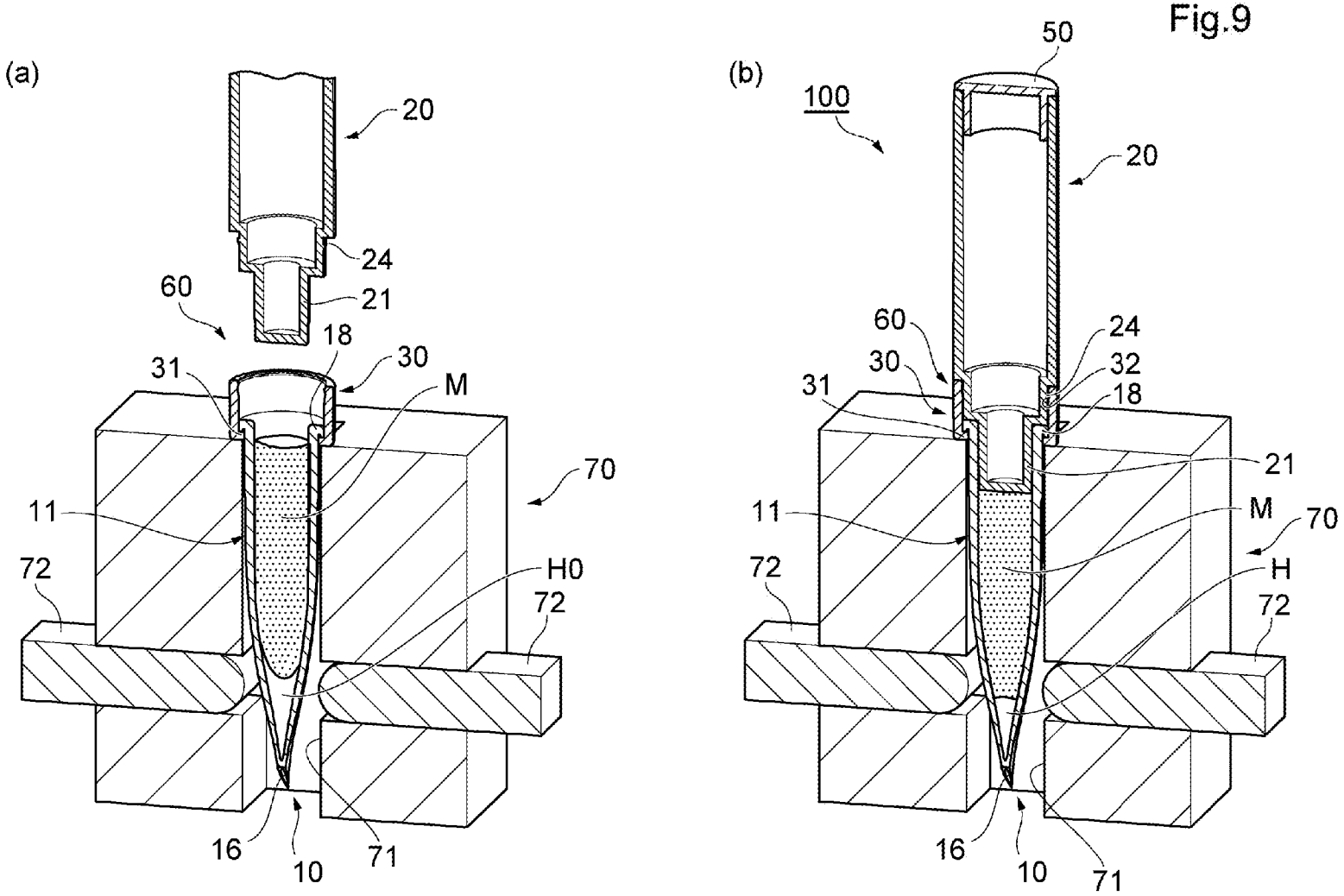
FIG. 9 is further another view illustrating the method of manufacturing the applying material extruding container of FIG. 1.

Thereafter, as illustrated in FIG. 9(*a*), the pair of pressing portions 72 are moved to be separated from each other and release the pressing against the sides of the filling portion 11 such that the filling portion 11 recovers to its original shape. Accordingly, a temporary space HO is formed which is defined by the inner wall of the leading portion 10 and the front end surface of the applying material M on the discharge portion 16 side in the leading portion 10 (first step).

Subsequently, as illustrated in FIGS. 9(*a*) and 9(*b*), a predetermined amount of the inserting portion 21 of the grip tube 20 to which the tail plug 50 is mounted is inserted and fitted into the shape-recovered filling portion 11 from the rear side. At this time, the annular convex portion 24 is engaged with the annular concave portion 32 in the axial direction and the rear end portion of the filling portion 11 is interposed between the front end portion of the middle member 30 and the inserting portion 21. Accordingly, the grip tube 20 can be assembled to the container middle body 60. As a result, the inserted applying material M is moved forward to be extruded and air in the temporary space HO is discharged from the discharge portion 16 of the leading portion 10. Due to this movement, the temporary space HO is appropriately changed so that the predetermined space H is defined on the discharge portion 16 side in the leading portion 10 (second step).

In addition, a timing at the grip tube 20 is inserted with respect to the release of the pressing by the pressing portions 72 (the shape recovery of the filling portion 11) may be appropriately selected depending on the hardness of the applying material M, the filling conditions, and the like. For example, the insertion of the grip tube 20 may be performed before releasing the pressing by the pressing portions 72. Otherwise, the grip tube 20 may be inserted after slightly releasing the pressing by the pressing portions 72, and thereafter, the pressing may be completely released.

Figure 10:
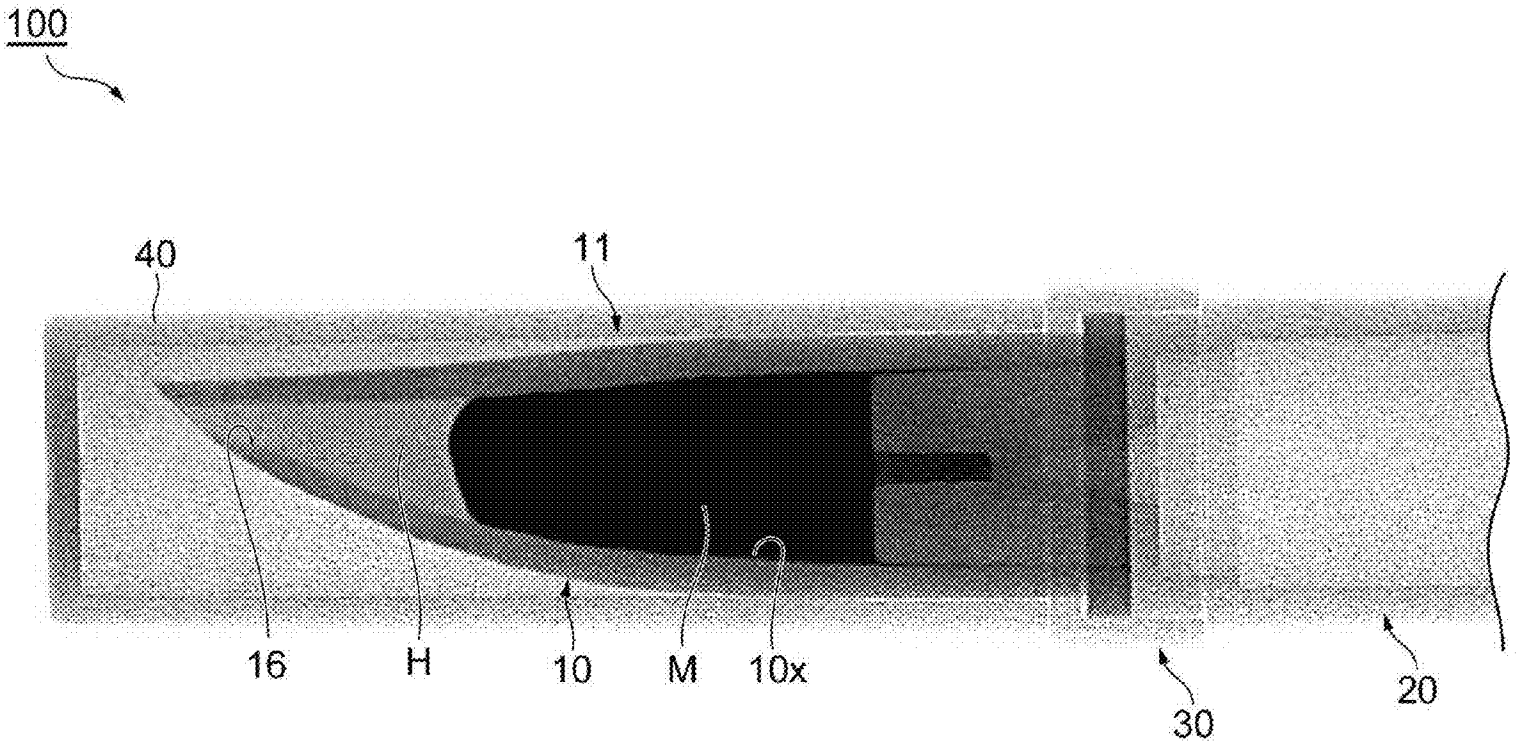
FIG. 10 is an X-ray photograph showing the applying material extruding container of FIG. 1.

FIG. 10 is an X-ray photograph showing the applying material extruding container 100 of FIG. 1, which is manufactured by the above-described manufacturing method. As illustrated in FIG. 10, in the applying material extruding container 100 of this embodiment, it can be confirmed that on the discharge portion 16 side in the leading portion 10, the predetermined space H which is completed by inserting the applying material M in the state where the filling portion 11 is compressed and deformed, thereafter recovering the shape of the filling portion 11, and assembling the grip tube 20 to the filling portion 11 to move the applying material M is defined by the inner wall of the filling portion 11 and the front end surface of the applying material M.

Hereinbefore, in this embodiment, the applying material extruding container 100 which has the predetermined space H as an easily and appropriately formed space on the discharge portion 16 side in the leading portion 10 can be realized. That is, for example, by using the leading portion 10 molded of the soft material, the predetermined space H optimized by inserting the above-described applying material M and performing assembly can be easily defined on the discharge portion 16 side in the leading portion 10. By the predetermined space H, it is possible to prevent the applying material M from naturally leaking out from the discharge portion 16 due to a temperature change or the like while necessarily and sufficiently ensuring the amount of the applying material M filling the filling portion 11.

In this embodiment, the collar portion 18 is provided on the outer peripheral surface of the rear end portion of the filling portion 11, and the inner peripheral projection 31 is provided on the inner peripheral surface of the front end portion of the middle member 30. In addition, the collar portion 18 and the inner peripheral projection 31 are engaged with each other. Therefore, it is possible to prevent the leading portion 10 from being separated from the grip tube 20.

In this embodiment, the rear end portion of the filling portion 11 in the leading portion 10 is interposed between the inserting portion 21 of the grip tube 20 and the front end portion of the middle member 30 in the radial direction. Therefore, it is possible to further prevent the leading portion 10 from being separated from the grip tube 20. Moreover, the inside diameter of the rear portion of the leading portion 10 comes into close contact with the inserting portion 21 and thus airtightness therebetween can be reliably ensured. Furthermore, when the inserting portion 21 is inserted into the filling portion 11, since a vertical groove 26 (see FIG. 5) that extends in the axial direction is formed in the outer peripheral surface of the inserting portion 21, air in the rear portion of the filling portion 11 can be circulated via the vertical groove 26 in a predetermined section and can be discharged.

In addition, in this embodiment, the leading portion 10 is formed of the soft rubber of which the durometer hardness measured by the type A durometer is less than 80 or the elastic body made of the thermoplastic elastomer. On the other hand, the middle member 30 and the grip tube 20 are formed of the hard thermoplastic resin. By forming the leading portion 10, the middle member 30, and the grip tube 20 of such materials, the effect of preventing the leading portion 10 from being separated becomes significant.

The following results represent material comparison results of tensile strength measurement values of the applying material extruding container 100. In the following results, a numeral value regarding NBR represents the durometer hardness. ABS is the ABS resin (an acrylonitrile butadiene styrene copolymerized resin). Each numerical value regarding the tensile strength is the strength at which a tensile force can be borne without fracture (the components are not separated) in units of Newtons.

Comparative Example 1

The material of the leading portion 10: NBR 70 [degrees]
The material of the middle member 30: NBR 70 [degrees]
The material of the grip tube 20: NBR 70 [degrees], tensile strength: 7 [N]

Comparative Example 2

The material of the leading portion 10: NBR 70 [degrees]
The material of the middle member 30: NBR 70 [degrees]
The material of the grip tube 20: ABS resin, tensile strength: 11 [N]

Comparative Example 3

The material of the leading portion 10: NBR 70 [degrees]
The material of the middle member 30: ABS resin
The material of the grip tube 20: NBR 70 [degrees], tensile strength: 12 [N]

Example 1

The material of the leading portion 10: NBR 70 [degrees]
The material of the middle member 30: ABS resin
The material of the grip tube 20: ABS resin, tensile strength: 45 [N]

As shown in the material comparison results of the strength measurement values, in Example 1 (a case where the leading portion 10 is made of the NBR having a durometer hardness of 70 and both the middle member 30 and the grip tube 20 are made of the ABS resin) according to this embodiment, it could be confirmed that the tensile strength is high and the components are less likely to be separated from each other compared to Comparative Examples 1 to 3 (a case where the leading portion 10 is made of the NBR having a durometer hardness of 70 and the middle member 30 and the grip tube 20 are not made of the ABS resin at the same time). Accordingly, although the leading portion 10 is easily separated in the case where the leading portion 10 is formed of the soft material, it can be confirmed that the effect of preventing the leading portion 10 from being separated is significantly achieved by the applying material extruding container 100 of this embodiment.

In addition, in the applying material extruding container 100, since the applying portion 13 has a flat shape, when the user applies the applying material M using the applying material extruding container 100, the user can impart stiffness to the applying portion 13. Therefore, for example, the line of the applying material M can be stably pulled. Moreover, since the applying material extruding container 100 is configured without an additional extruding mechanism for extruding the applying material M from the container, the applying material M can be applied without the extruding mechanism. Accordingly, the simplification, manufacturing facilitation, and a reduction in cost of the applying material extruding container 100 can be achieved.

While the embodiment of the present invention has been described, the present invention is not limited to the above-described embodiment, and can be modified or applied to the other embodiments without departing from the gist described in the appended claims.

For example, in the above-described embodiment, the applying material M is inserted into the single applying material extruding container 100 by using the filling tool 70. However, the applying material M may also be simultaneously inserted and assembled in a plurality of applying material extruding containers 100 using a filling tool for which a plurality of container middle bodies 60 are filling objects. In the above-described embodiment, the filling portion 11 recovers to its original shape by releasing the pressing against the sides of the filling portion 11. However, the pressing against the sides of the filling portion 11 may not be released and the filling portion 11 may not recover to its original shape. Furthermore, the shape recovery includes not only a case of a complete shape recovery but also a case of a partial shape recovery.

What is claimed is:

1. An applying material extruding container comprising:

a leading portion which includes a filling portion filled with an applying material and a flat applying portion and is molded of a soft material; and a rear portion of the container which is inserted into the leading portion, wherein the container is configured to extrude the applying material from a discharge portion on a leading end side of the applying portion by pressing and deforming the filling portion so as to be used, an annular middle member which is engaged with the leading portion and the rear portion of the container is further included, an outer peripheral surface of a rear end portion in the filling portion is provided with an outer peripheral projection which extends along a peripheral direction, an inner peripheral surface of a front end portion in the middle member is provided with an inner peripheral projection which extends along the peripheral direction, the outer peripheral projection and the inner peripheral projection are engaged with each other at least in an axial direction, and wherein the rear end portion of the filling portion in the leading portion is always interposed between an inserting portion of the rear portion of the container which is inserted into the filling portion and the front end portion of the middle member in a radial direction.

2. The applying material extruding container according to claim 1, wherein the leading portion is formed of a soft rubber of which a durometer hardness measured by a type A durometer is less than 80 or an elastic body made of a thermoplastic elastomer, and the middle member and the rear portion of the container are formed of a hard thermoplastic resin.

3. The applying material extruding container according to claim 1, wherein the leading portion is formed of a soft rubber of which a durometer hardness measured by a type A durometer is less than 80 or an elastic body made of a thermoplastic elastomer, and the middle member and the rear portion of the container are formed of a hard thermoplastic resin.

* * * * *